US009220938B2

(12) United States Patent
Mellott

(10) Patent No.: US 9,220,938 B2
(45) Date of Patent: Dec. 29, 2015

(54) PLAYGROUND ASSEMBLY

(71) Applicant: Playworld Systems, Inc., Lewisburg, PA (US)

(72) Inventor: Craig Mellott, Beavertown, PA (US)

(73) Assignee: Playworld Systems, Inc., Lewisburg, PA (US)

( * ) Notice: Subject to any disclaimer, the term of this patent is extended or adjusted under 35 U.S.C. 154(b) by 61 days.

(21) Appl. No.: 14/098,040

(22) Filed: Dec. 5, 2013

(65) Prior Publication Data

US 2015/0157891 A1 Jun. 11, 2015

(51) Int. Cl.

| | |
|---|---|
| ***A63G 9/00*** | (2006.01) |
| ***A63B 9/00*** | (2006.01) |
| *A63G 21/00* | (2006.01) |

(52) U.S. Cl.

CPC ..... *A63B 9/00* (2013.01)

(58) Field of Classification Search

CPC ..... A63G 21/00; A63G 21/04; A63B 9/00; A63B 2009/002; A63B 2009/006

USPC ..... 472/116, 117; 482/35, 36

See application file for complete search history.

(56) References Cited

U.S. PATENT DOCUMENTS

| | | | | |
|---|---|---|---|---|
| 2,779,596 A * | 1/1957 | Ridgway | A63G 31/00 182/48 |
| 3,850,428 A * | 11/1974 | Zuber | 482/36 |
| 5,246,401 A * | 9/1993 | Boatwright | 472/116 |
| 5,496,232 A * | 3/1996 | Morris et al. | 482/35 |
| 8,771,093 B2 * | 7/2014 | Bowen | 472/116 |

* cited by examiner

*Primary Examiner* — Kien Nguyen

(74) *Attorney, Agent, or Firm* — McNees Wallace & Nurick LLC

(57) ABSTRACT

In one embodiment, a playground assembly includes a beam having a first end, a second end opposite the first end, and a longitudinal axis that extends between the first end and the second end such that the beam is elongate along the longitudinal axis. The beam defines a length measured between the first end and the second end along the longitudinal axis, and a width measured in a direction perpendicular to the length, wherein the length is at least five times greater than the width and the beam is at a height above a ground level. The playground assembly also includes at least one flexible strip extending between the beam and the ground level.

22 Claims, 6 Drawing Sheets

PLAYGROUND ASSEMBLY

TECHNICAL FIELD

The playground assembly described herein may be configured as a stand-alone playground apparatus or as part of a larger playground system.

BACKGROUND

Playground systems typically have a "post and deck" structure with modular components that are designed for either climbing up or sliding down. Children enter such structures through a climbing module, move to a sliding module, and exit the structure. While such designs are intuitive to use, they impede creativity and, when used in unintended ways, can create safety hazards.

SUMMARY

In one embodiment, a playground assembly includes a beam having a first end, a second end opposite the first end, and a longitudinal axis that extends between the first end and the second end such that the beam is elongate along the longitudinal axis. The beam defines a length measured between the first end and the second end along the longitudinal axis, and a width measured in a direction perpendicular to the length, wherein the length is at least five times greater than the width and the beam is at a height above a ground level. The playground assembly also includes at least one flexible strip extending between the beam and the ground level.

In another embodiment, a playground assembly includes a beam having a first end, a second end opposite the first end, and a longitudinal axis that extends between the first end and the second end such that the beam is elongate along the longitudinal axis. The beam has a first side wall and a second side wall that face opposite each other and each extend between the first end and the second end. The beam is supported at a height above a ground level. The playground assembly further includes a first flexible strip extending between the first side wall of the beam to a first anchor point on the ground level and a second flexible strip extending between the second side wall of the beam to a second anchor point on the ground level.

Alternatively, a playground assembly includes a beam having a first end, a second end opposite the first end, and a longitudinal axis that extends between the first end and the second end such that the beam is elongate along the longitudinal axis. The beam defines a length measured between the first end and the second end along the longitudinal axis, and a width measured in a direction perpendicular to the length, wherein the length being at least five times greater than the width. The beam includes a top surface, a bottom surface opposite the top surface, a first side, and a second side, wherein the first side and the second side are opposite each other and the first side and the second side extend between the top surface and the bottom surface. The playground assembly further includes a frame that supports the beam such that the bottom surface of the beam is at a height above a ground level. Additionally, the playground assembly includes a first flexible strip that extends along a first curved path between the first side of the beam and a first anchor point on the ground level and a second flexible strip that extends along a second curved path between the second side of the beam and a second anchor point on the ground level.

DETAILED DESCRIPTION OF INVENTION

Figure 1:
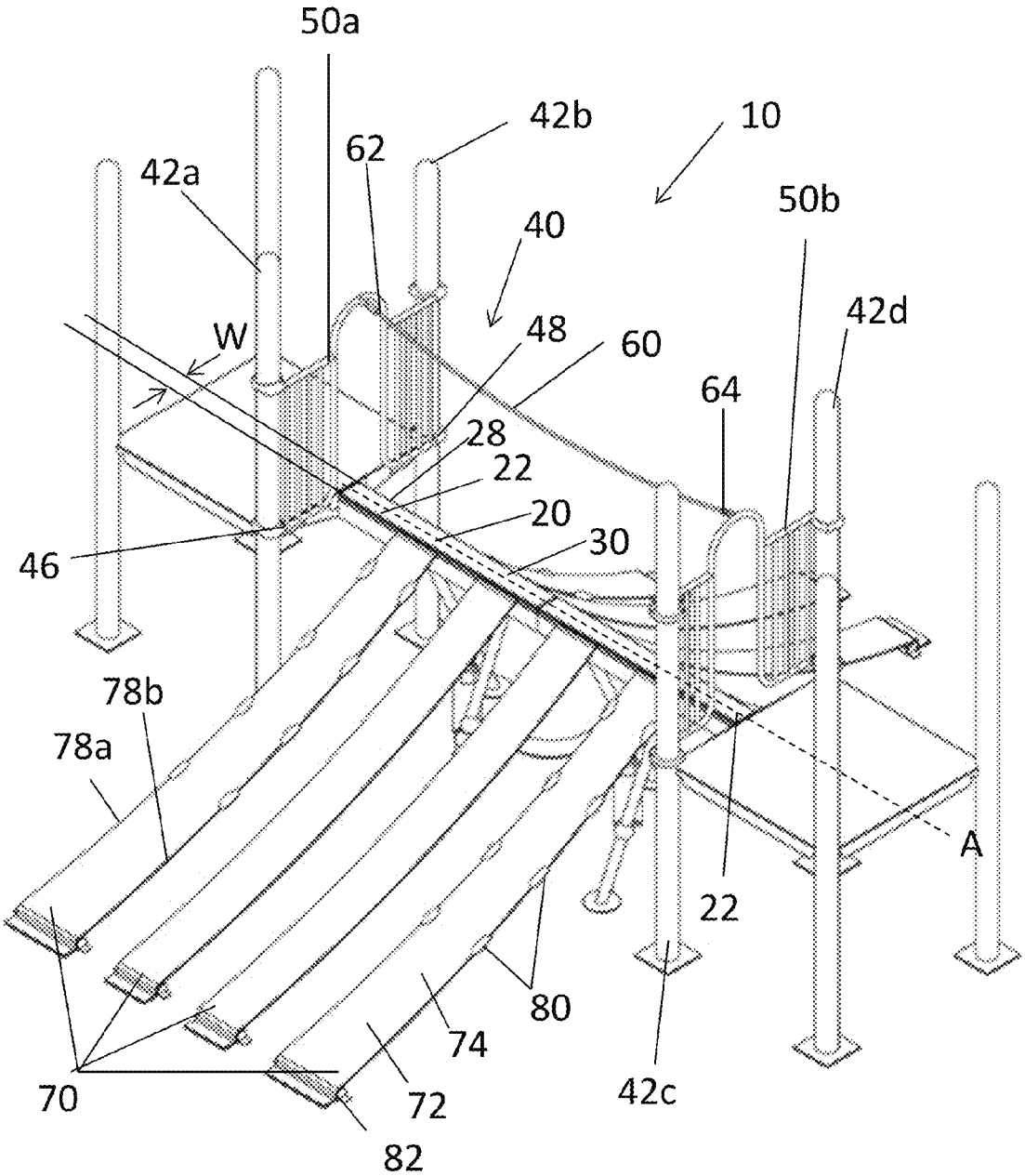
FIG. 1 is a perspective view of a playground assembly that includes a frame, a beam, flexible strips extending from the beam, and an under-beam subassembly disposed below the beam.
Figure 2:
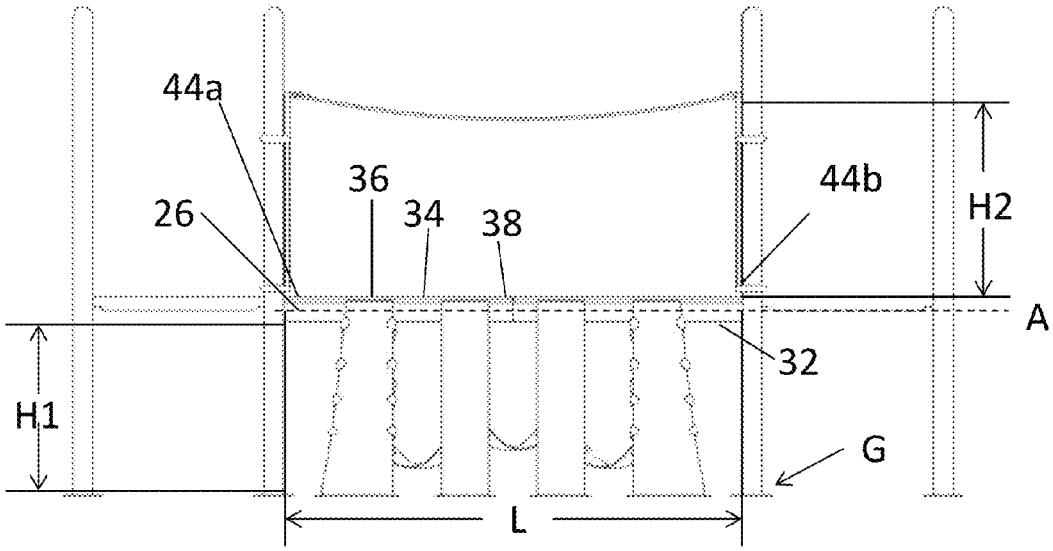
FIG. 2 is a front elevation view of the playground assembly shown in FIG. 1.
Figure 3:
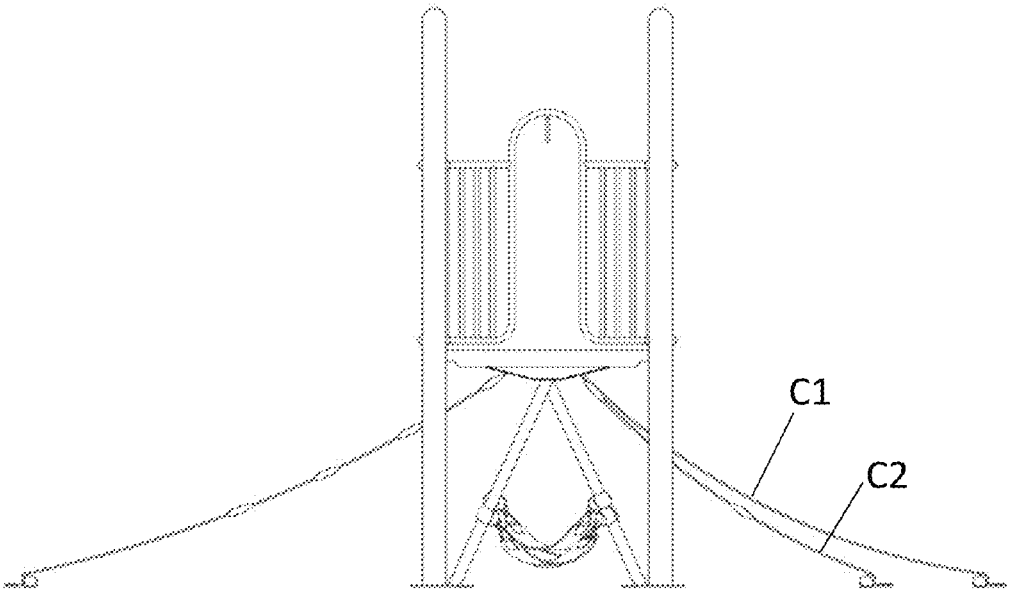
FIG. 3 is a side elevation view of the playground assembly shown in FIGS. 1 and 2.

As illustrated in FIGS. 1-3, a playground assembly 10 includes a beam 20 supported at a height $H_1$ above a ground level G by a frame 40. Flexible strips 70 extend between the beam 20 and ground level G. A flexible cable 60 is also supported by the frame 40 and extends between a first end 72 and a second end 74 of the beam 20 at a second height $H_2$ above the ground level G. The playground assembly 10 further comprises an under-beam subassembly 100 that extends between the beam 20 and the ground level G.

Beam 20 has a first end 22, a second end 24 opposite the first end 22. A longitudinal axis A extends between the first end 22 and the second end 24 such that the beam is elongate along the longitudinal axis A. Beam 20 defines a length L measured between the first end 22 and the second end 24 along the longitudinal axis A. Beam 20 further defines a width W measured in a direction perpendicular to the length L. Beam 20 also defines a thickness T, measured in a direction perpendicular to length L and width W. Length L is significantly greater than width W. For example, length L may be at least five times width W. Length L may be 120 inches and width W may be 6 inches, such that the ratio of length to width is 20. Beam 20 may have a thickness of 6.25 inches.

Beam 20 has a top surface 30 and a bottom surface 32 opposite the top surface 30 that extends between the first end 22 and the second end 24. Front sidewall 26 and rear sidewall 28 extend between the top surface 30 and the bottom surface 32 and are opposite one another. Corners where top surface 30 meets front sidewall 26 and rear sidewall 28 may be rounded. Beam 20 may be made of metal, such as powder coated steel.

As shown in FIG. 2, a cap 34 is attached to the top surface 30 of the beam 20. Cap 34 includes cutouts 36 which correspond to the widths flexible strips 50. Cutouts 36 are configured to minimize movement of the flexible strips 50 along longitudinal axis A. A pad 38, such as a rubber pad, may be mounted to the cap 34 to provide a walking surface for users of the playground assembly 10. Pad 38 may be bolted and/or glued to the cap 34 and/or beam 20. Pad 34 may be textured so as to create friction with a user's shoes or feet in order to minimize slippage.

Figure 10:
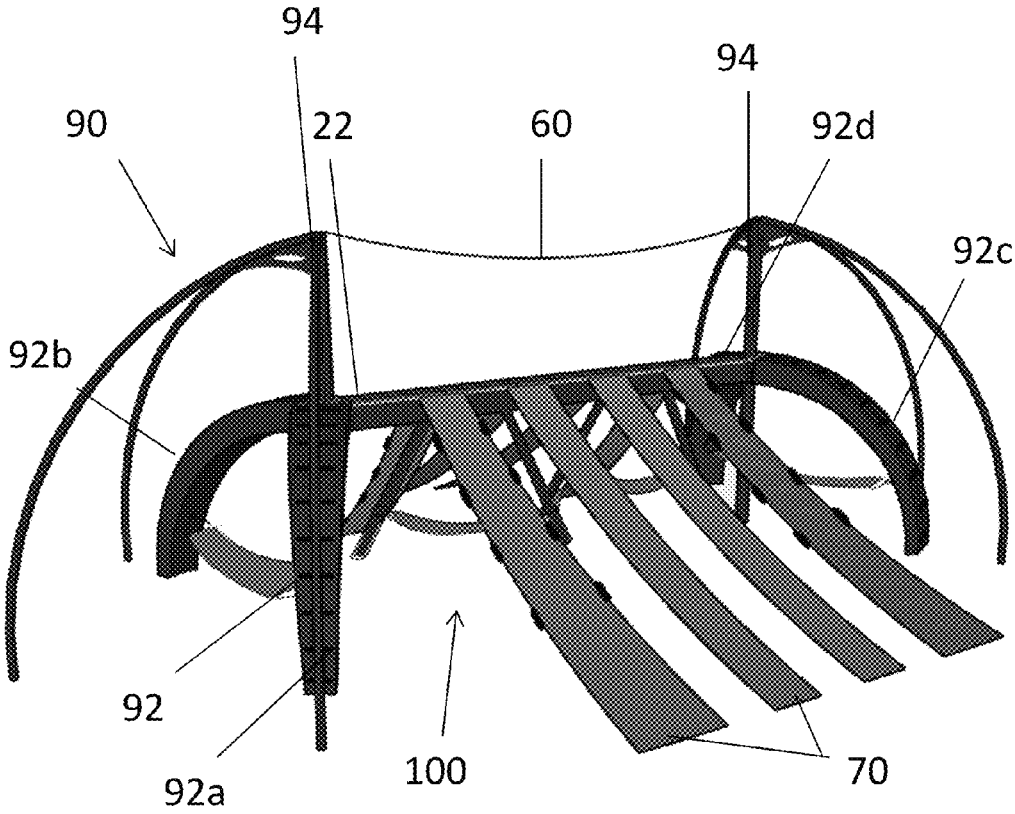
FIG. 10 is a perspective view of a fifth playground assembly that includes a frame, a beam, flexible strips extending from the beam, and an under-beam subassembly disposed below the beam.

Frame 40 includes four posts 42*a-d* that extend from the ground level G. FIG. 1 shows posts 42*a-d* as extending perpendicular to the ground level G and longitudinal axis A, but posts 42*a-d* can also extend traverse to ground level G. Further, two of the posts may be unitary such that they connect at a top end. Alternatively, a single post may be used in place of two posts. Frame 40 further includes cross-members 44*a,b* extend between posts 42*a,b*, 42*c,d*, respectively. Each cross-member 44*a,b* has a first end 46 and a second end 48 opposite the first end 46 that are secured to one of the posts 42*a-d*. First and second ends 22, 24 of beam 20 are bolted to cross-members 44*a,b*. Cross-members 44*a,b* may be crossbeams or platforms. Cross-members 44*a,b* may optionally be configured to be attachable to other portions of a playground apparatus. Alternatively, as shown in FIG. 10, and described in greater detail below, beam 20 connects to arches 92*a-d* that extend between the ground and the beam to support the beam at height $H_1$. Frame 40 also includes gates 50*a,b* extend between posts 42*a,b*, 42*c,d*, respectively and connect to cross-members 44*a,b*. Like beam 20, posts 42*a-d* and gates 46*a,b* may be made of metal, such as powder coated steel. Cross-members 44*a,b* may be made of metal, such as powder coated steel or polyethylene coated steel.

A flexible cable 60 extends between gates 46*a,b*. A first end 62 of cable 60 connects to one of the gates 46*a* and a second end 64 of the cable connects to the other gate 46*b* such that cable 60 hangs at a height $H_2$ above the ground level G. For example, cable 60 may be positioned above the beam 20 such that a user walking on the beam 20 may grip the cable 60 for support. For example, cable 60 may have an average height above the beam in the range of 40-60 inches, such as 45-55 inches. Cable 60 may have an average height of 50 inches above the beam 20. Cable 60 may be flexibly connected to gate 46*a,b*, or fixedly connected to gate 46*a,b*. Cable 60 may be made of metal, such as steel, coated with polyester. Alternatively, cable 60 may be made entirely of synthetic material.

Figure 8:
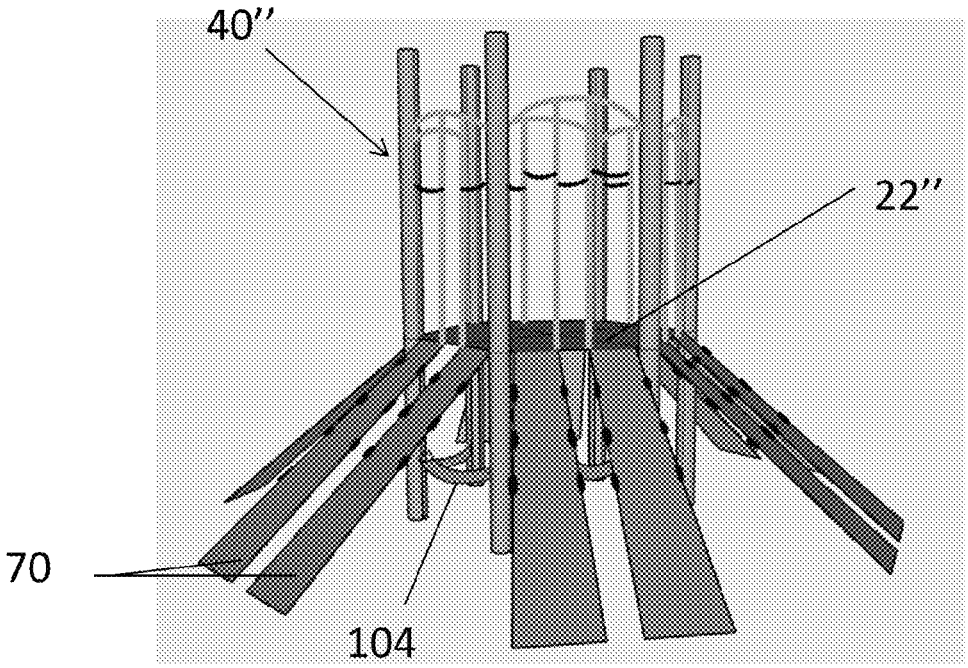
FIG. 8 is a perspective view of a third playground assembly that includes a hexagonal platform and flexible strips extending from sides of the hexagonal platform.
Figure 9:
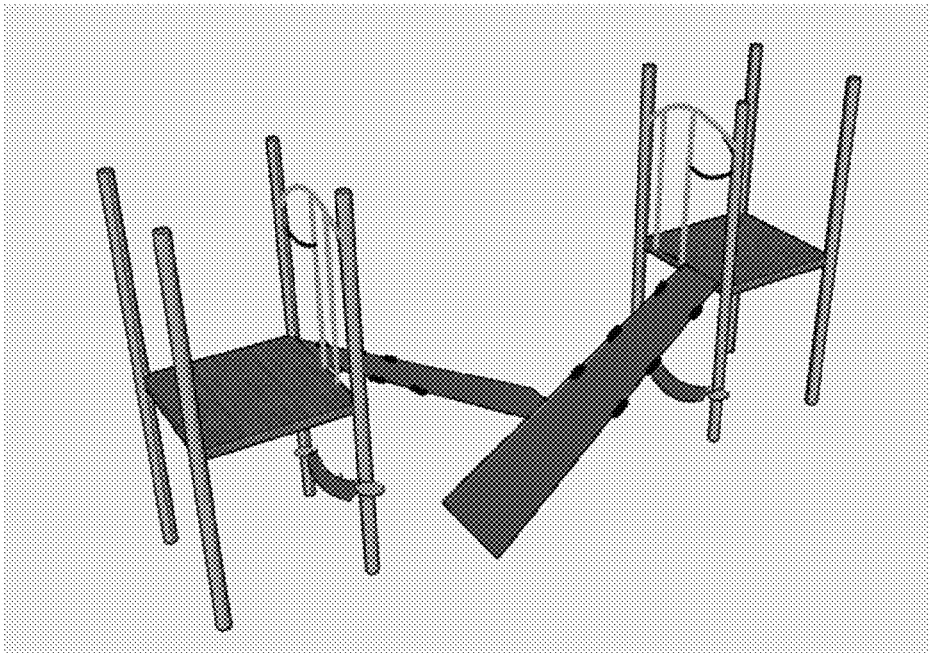
FIG. 9 is a perspective view of a fourth playground assembly that includes a pair of platforms that have flexible strips extending from each platform in opposite directions.

Flexible strips 70 extend between either of the front sidewall 26 or the rear sidewall 28 of the beam 20 and the ground level G along an approximately curved paths, such as paths $C_1$ and $C_2$ shown in FIG. 3. Curves $C_1$ and $C_2$ may be identical to or different from one another. As shown in FIGS. 8 and 9, flexible strips 70 can also extend between approximately straight along a line. Flexible strips 70 may be spaced in relation to each other such that flexible strips 70 are separated by the approximate width of each strip. For example, strips 70 may be 11.75 inches wide and spaced 12.25 inches from each other. Alternatively, flexible strips 70 may be separated by more or less than the approximate width of each strip. Flexible strips 70 may be spaced such that a child using the playground assembly 10 can walk on the ground between the strips 70.

In FIG. 1, flexible strips 70 are shown extending parallel to each other on either side of beam 20. Four strips 70 are shown extending from both sides of beam 20. While flexible strips 70 are shown extending perpendicular to the beam 20, flexible strips 70 may have alternative arrangements in relation to the beam, such as extending traverse to the beam 70.

Flexible strips 70 are each fixedly secured the beam and to an anchor point 82 at the ground level G. Flexible strips 70 may be unitary such that they extend from an anchor point 82 on one side of the beam 20, over the beam 20, to an anchor point 82 on the other side of the beam 20. Flexible strips 70 may alternatively extend on one side of the beam. Flexible strips 70 may be bolted to the beam 20 and further secured by cap 34 as described above. As described above, corners of the beam may be rounded so as to minimize wear on the flexible strips 70 as they bend over the beam 20.

Figure 4:
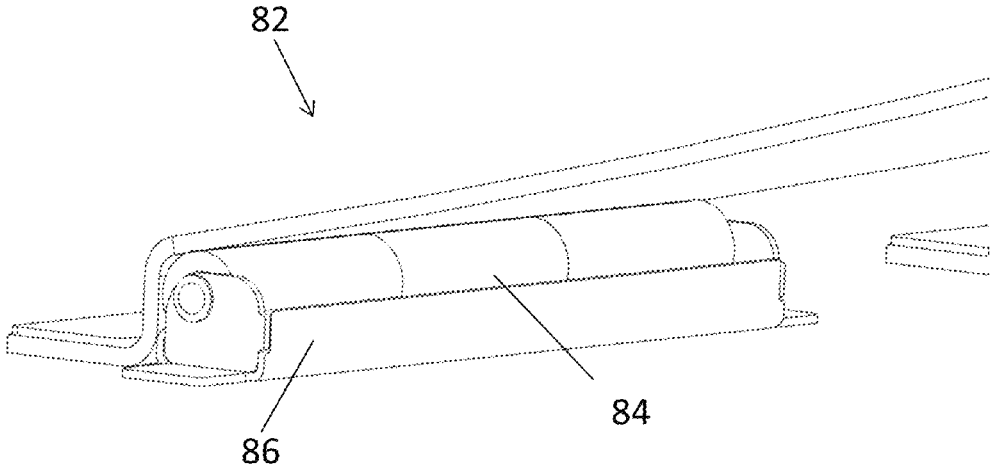
FIG. 4 is a perspective view of a portion of flexible strips shown in FIGS. 1-3.

As shown in FIG. 4, anchor point 82 includes a dowel 84 and an anchor frame 86 that secures the dowel 84 to the ground. Flexible strip 70 is wound about a dowel 84 and secured by bolts such that the flexible strip 70 bears its load about the curve of the dowel. In this way, the flexible strip 70 is protected from tearing at bolt hole locations or on any sharp corners. Dowel 84 may be made of a urethane tube. Alternatively, dowel 84 may be made of a material with similarly elastic properties. Anchor frame 86 and the bolts that secure the flexible strip 70 to the ground may be held in place by poured concrete underneath the playground surface. For example, projections (not shown) on anchor frame 86, and the bolts may extend 2-12 inches under the surface of the playground and held in a concrete block. Wood chips or synthetic surfacing cover the concrete block.

Figure 6:
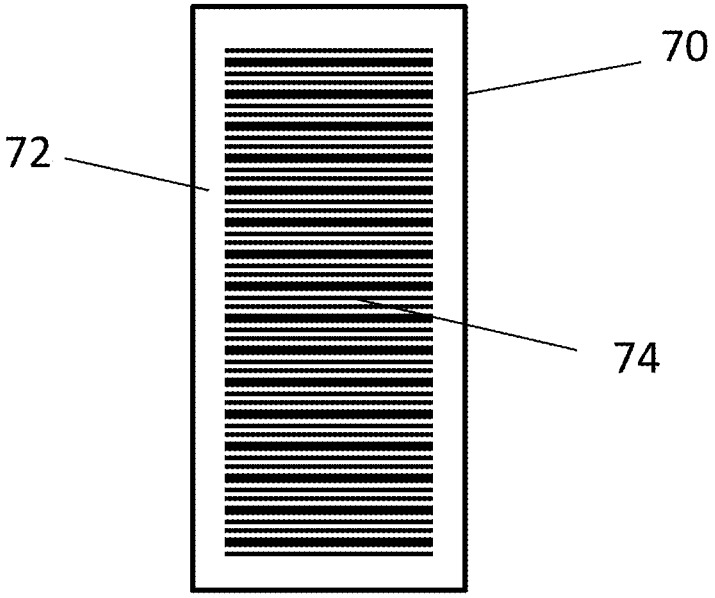
FIG. 6 is a schematic view of the flexible strips shown in FIGS. 1-5.

Each flexible strip 70 has a top surface 72 and a bottom surface 76 opposite the top surface. Sidewalls 78*a,b* extend between the top and bottom surfaces 72, 76, and opposite to each other. Top surface 72 may include textured treads 74 (shown in FIG. 6), such as ridges, that are configured to provide friction between a user's sneakers or feet so as to minimize slippage. Flexible strips 70 may also include handgrips 80 secured to sidewalls 78*a,b*. Handgrips 80 provide support for a user as the user climbs up or down the flexible strip 70. Handgrips 80 may be formed of injection molded plastic.

Flexible strips 70 may be made of a durable and flexible material, such as styrene butadiene rubber (SBR) with two plies of polyester reinforcement. This material, in conjunction with a slight slack between the two mounting connections on the beam 20 and anchor point 82 provide for durable flexing during play. For example, flexible strips 70 have elastic properties such that strips 70 stores and releases potential energy as a user imparts and removes his or her bodyweight on the strips. Flexible strips 70 are also resistant to wear and weather-related deterioration.

Figure 5:
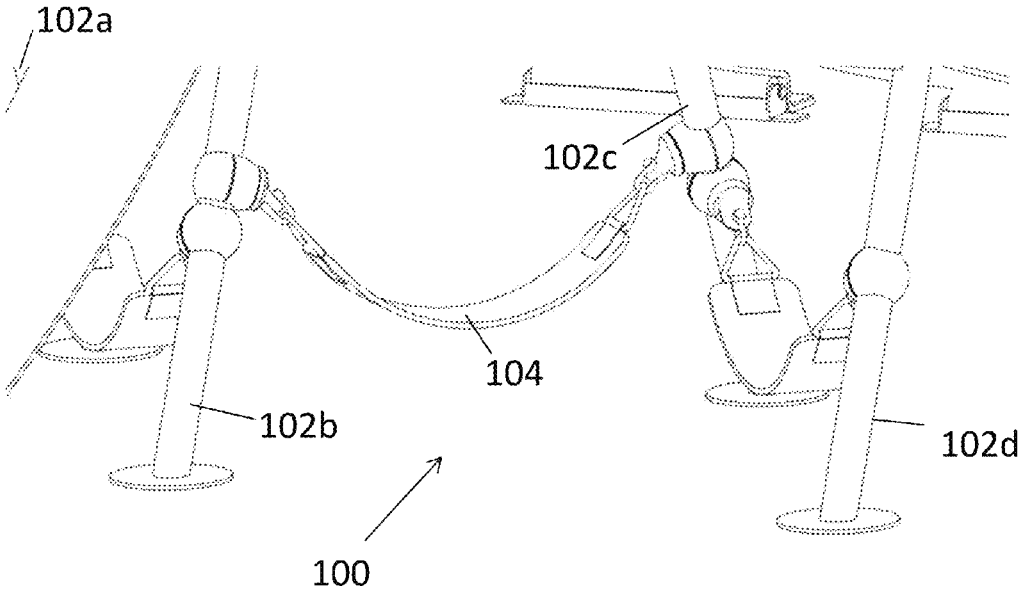
FIG. 5 is a perspective view of another portion of the underbeam subassembly shown in FIGS. 1-4.

As shown in FIG. 5, under-beam subassembly 100 is situated under beam 20, between flexible strips 70. Subassembly 100 includes extension members 102*a-d* and seats 104, such as hammock-style seats that extend between pairs of extension members 102*a-d*, respectively. Extension members 102*a-d* each connect to the bottom 32 of beam 20 and extend traverse to ground level G. Alternatively, some or all of extension members 102*a-d* may extent perpendicular to ground level G. Opposing ends of each seat 104 are pivotably mounted on extension members 102. Users can sit, lie, stand, or squat on seats 104 while griping one or more extension member 102*a-d*. Extension members 102*a-d* may be made of metal, such as powder coated steel. Seats 104 may be made of material that is the same as or similar to flexible strips 70, such as styrene butadiene rubber (SBR).

Figure 7:
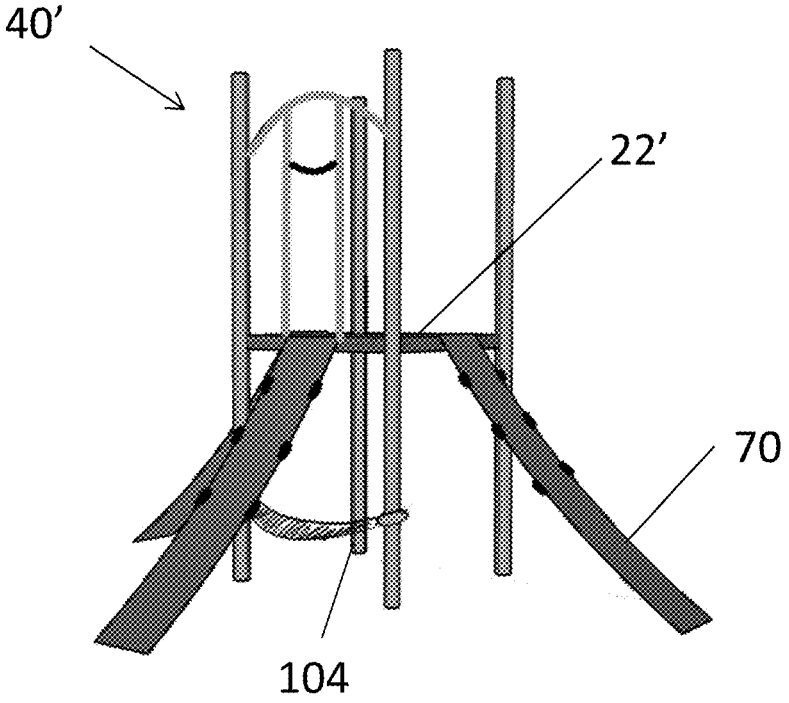
FIG. 7 is a perspective view of another playground assembly that includes a square platform and flexible strips extending from sides of the square platform.

Other configurations of playground assembly 10 are shown in FIGS. 7-10. For example, as shown in FIG. 7, flexible strips 70 extend from a square platform 22' mounted to frame 40'. Seat 104 is mounted to the frame. Three flexible strips 70 extend from three sides of the square platform 22', respectively. In FIG. 8, flexible strips 70 extend from a hexagonal platform 22" mounted to frame 40". Pairs of flexible strips 70 extend from each of the six sides of the hexagonal platform 22". Seats 104 are mounted to the frame 40". In FIG. 9, a pair of square platforms 22' are each supported by frames 40'. Flexible strips 70 extend from each square platform 22' in opposite directions. FIG. 10 shows a playground assembly with flexible strips 70 in a similar configuration to those shown in FIGS. 1-6, but with an alternate frame 90. Specifically, beam 20 is supported by arches 90*a-d*. Arches 90*a, b* support the first end 22 and arches 90*c, d* support the second end 24. Arches 90*a-d* may include treads 92 to assist users in climbing. Frame 90 further includes extensions 94 that support cable 60. Seats 104 are part of under-beam subassembly 100 and also mount to arches 90*a-d*.

The embodiments shown in the figures and described above illustrate aspects of the present invention. The present invention is not limited to the particular embodiments shown in the figures, but encompasses structures and methods broader than the disclosure and is limited only by the claims.

What is claimed:

1. A playground assembly comprising:

a beam having a first end, a second end opposite the first end, and a longitudinal axis that extends between the first end and the second end such that the beam is elongate along the longitudinal axis, the beam defining a length measured between the first end and the second end along the longitudinal axis, and a width measured in a direction perpendicular to the length, the length being at least five times greater than the width, wherein the beam is at a height above a ground level; and at least one flexible strip extending between the beam and an anchor point on the ground level, the anchor point comprising an anchor frame.

2. The playground assembly of claim 1 further comprising a frame that supports the beam at the height above the ground level.

3. The playground assembly of claim 2 wherein the frame comprises at least four posts and two cross-members, each cross-member having a first end, and a second end opposite the first end, each of the first and second ends being secured to one of the posts, respectively, wherein the first end of the beam is secured to one of the cross-members, and the second end of the beam is secured to the other cross-member.

4. The playground assembly of claim 3 wherein the cross-member is a crossbeam.

5. The playground assembly of claim 3 wherein the cross-member is a platform.

6. The playground assembly of claim 1 further comprising a pair of extension members that extend between the beam and the ground level and a seat that extends between the pair of extension members.

7. The playground assembly of claim 6 wherein the seat is pivotably attached to the pair of extension members.

8. The playground assembly of claim 1 further comprising four extension members that extend between the beam and the ground level and three seats that each extend between two of the extension members.

9. The playground assembly of claim 1, wherein the height is a first height, and wherein the playground assembly further comprises a flexible cable that extends between the first end and the second end of the beam at a second height above the ground level.

10. A playground assembly comprising:

a beam having a first end, a second end opposite the first end, and a longitudinal axis that extends between the first end and the second end such that the beam is elongate along the longitudinal axis, the beam further having a first side wall and a second side wall that each extend between the first end and the second end, the second side wall facing opposite the first side wall, wherein the beam is supported at a height above a ground level;

a first flexible strip extending between the first side wall of the beam to a first anchor point on the ground level; and a second flexible strip extending between the second side wall of the beam to a second anchor point on the ground level, each of said first and second anchor points comprises an anchor frame.

11. The playground assembly of claim 10 wherein at least one of the flexible strips has a ridged top surface.

12. The playground assembly of claim 10 further comprising hand grips attached to sides of at least one of the flexible strips.

13. The playground assembly of claim 10 further comprising a third flexible strip extending between the first side wall of the beam and a third anchor point on the ground level and a fourth flexible strip extending between the second side wall of the beam and a forth anchor point on the ground level.

14. A playground assembly comprising:

a beam having a first end, a second end opposite the first end, and a longitudinal axis that extends between the first end and the second end such that the beam is elongate along the longitudinal axis, the beam defining a length measured between the first end and the second end along the longitudinal axis, and a width measured in a direction perpendicular to the length, the length being at least five times greater than the width, the beam further comprising:

a top surface;

a bottom surface opposite the top surface;

a first side; and a second side, wherein the first side and the second side are opposite each other and the first side and the second side extend between the top surface and the bottom surface;

a frame that supports the beam such that the bottom surface is at a height above a ground level;

a first flexible strip that extends along a first curved path between the first side of the beam and a first anchor point on the ground level; and a second flexible strip that extends along a second curved path between the second side of the beam and a second anchor point on the ground level, each of said first and second anchor points comprises an anchor frame.

15. The playground assembly of claim 14 further comprising a third flexible strip extending between the first side of the beam and a third anchor point on the ground level and a fourth flexible strip extending between the second side of the beam and a forth anchor point on the ground level.

16. The playground assembly of claim 14 wherein the frame comprises at least four posts and two cross-members, each cross-member having a first end, and a second end opposite the first end, each of the first and second ends being secured to one of the posts, respectively, wherein the first end of the beam is secured to one of the cross-members, and the second end of the beam is secured to the other cross-member.

17. The playground assembly of claim 16 wherein the cross-member is a crossbeam.

18. The playground assembly of claim 14 further comprising a pair of extension members that extend between the beam and the ground level and a seat that extends between the pair of extension members.

19. The playground assembly of claim 18 wherein the seat is pivotably attached to the pair of extension members.

20. The playground assembly of claim 14, wherein the height is a first height, and wherein the playground assembly further comprises a flexible cable that extends between the first end and the second end of the beam at a second height above the ground level.

21. A playground assembly comprising:

a beam having a first end, a second end opposite the first end, and a longitudinal axis that extends between the first end and the second end such that the beam is elongate along the longitudinal axis, the beam defining a length measured between the first end and the second end along the longitudinal axis, and a width measured in a direction perpendicular to the length, the length being at least five times greater than the width, wherein the beam is at a height above a ground level;

at least one flexible strip extending between the beam and the ground level; and a pair of extension members that extend between the beam and the ground level and a seat that extends between the pair of extension members.

22. A playground assembly comprising:

a beam having a first end, a second end opposite the first end, and a longitudinal axis that extends between the first end and the second end such that the beam is elongate along the longitudinal axis, the beam defining a length measured between the first end and the second end along the longitudinal axis, and a width measured in a direction perpendicular to the length, the length being at least five times greater than the width, wherein the beam is at a height above a ground level; and at least one flexible strip extending between the beam and the ground level, wherein the height is a first height, and wherein the playground assembly further comprises a flexible cable that extends between the first end and the second end of the beam at a second height above the ground level.

* * * * *